US005235942A

United States Patent [19]

Olmr

[11] Patent Number: 5,235,942

[45] Date of Patent: Aug. 17, 1993

[54] CYLINDER HEAD ASSEMBLY

[75] Inventor: Jaroslav J. Olmr, Sheboygan, Wis.

[73] Assignee: Kohler Co., Kohler, Wis.

[21] Appl. No.: 995,850

[22] Filed: Dec. 23, 1992

[51] Int. Cl.[5] ..... F01L 1/18

[52] U.S. Cl. ..... 123/90.27; 123/90.41; 123/90.44; 74/519; 74/559

[58] Field of Search ..... 123/90.27, 90.39, 90.4, 123/90.41, 90.44, 90.42, 90.43; 74/519, 559

[56] References Cited

U.S. PATENT DOCUMENTS

| | | | |
|---|---|---|---|
| 2,939,443 | 7/1960 | Oechsner | 123/90.27 |
| 3,563,214 | 2/1971 | Medenus | 123/90.44 |
| 3,610,218 | 10/1971 | Durham | 123/90.41 |
| 4,036,185 | 7/1977 | Key | 123/90.39 |
| 4,192,263 | 3/1980 | Kitagawa et al. | 123/90.39 |
| 4,682,575 | 7/1987 | Simko | 123/90.39 |
| 4,723,515 | 2/1988 | Burandt | 123/90.45 |
| 4,727,832 | 3/1988 | Miyamura et al. | 123/90.39 |
| 4,787,346 | 11/1988 | Ajiki et al. | 123/90.39 |
| 4,793,297 | 12/1988 | Fujii et al. | 123/90.44 |
| 5,046,462 | 9/1991 | Matayoshi et al. | 123/90.39 |
| 5,095,861 | 3/1992 | Dove, Jr. | 123/90.39 |

FOREIGN PATENT DOCUMENTS

| | | | |
|---|---|---|---|
| 1298410 | 3/1987 | U.S.S.R. | 123/90.39 |
| 209685 | 1/1924 | United Kingdom . | |

*Primary Examiner*—Willis R. Wolfe
*Assistant Examiner*—Weilun Lo
*Attorney, Agent, or Firm*—Quarles & Brady

[57] ABSTRACT

A cylinder head assembly is disclosed for an internal combustion engine which has a cylinder head with a reciprocal valve member. A rocker arm is pivotably positioned in the cylinder head in a low and compact manner for actuation of the valve member. Camming surfaces are located between a rotatable shaft and an interior surface of the rocker arm. In a preferred form, the rocker arm has a yoke shaped body formed by an elongated top bar and an enclosed loop hanging down from the bar to define an internal cavity for camming contact with a cam member at a lower portion of the loop to effect a dragging action of the rocker arm in a manner substantially parallel to the valve member.

12 Claims, 2 Drawing Sheets

CYLINDER HEAD ASSEMBLY

BACKGROUND OF THE INVENTION

A. Field of the Invention

This invention relates to cylinder head assemblies for internal combustion engines which have intake and exhaust valves. More particularly, the invention relates to an improved rocker arm for operating the valves.

B. Description of the Art

Many engines have the cam shafts and rocker arms placed in elevated positions above the valve member. This design is not compact and requires extra linkages.

Others employ push rods to activate rocker arms with the push rods positioned at the side of the cylinders. This interferes with cooling, and also takes up some space that could be otherwise used for other engine components.

In the instance where the rocker arm has been positioned lower in the engine head (e.g. U.S. Pat. No. 3,563,214) and without the use of rocker push rods, there is a problem with the rocker arm having the strength to withstand contact forces by the camming surface as the cam shaft engages the rocker arm in a lateral manner. Also, the forces the rocker arm exerts on the valve stem act around a fulcrum and thus have a substantial undesired lateral vector component.

An improved rocker arm is therefore desired.

SUMMARY OF THE INVENTION

In one embodiment, the present invention includes a cylinder head assembly for an internal combustion engine having a cylinder head with a reciprocal valve member. A fulcrum and a rotatable shaft are positioned in the cylinder head. A rocker arm is linked to the fulcrum at a point adjacent a first rocker arm end, and in contact with the valve member adjacent a second rocker arm end. There are camming surfaces formed along an interface between the rotatable shaft and an interior surface of the rocker arm with the camming surfaces being located between the rocker arm ends and below the contact point of the rocker arm to the valve member.

In one aspect, the rocker arm comprises a straight upper portion and a loop extending below a straight portion. There is a cam projection on the rotatable shaft and the rocker arm has a wear surface on an interior lower surface of the loop against which the cam on the rotatable shaft can abut.

In another aspect, there are two such rocker arms positioned in a side-by-side manner with respect to each other, and at least two such valve members, wherein the same fixed shaft acts as a fulcrum for both rocker arms, and the same rotatable shaft has cams that abut the rocker arms.

In yet another aspect, the cam on the rotatable shaft drags the rocker arm downward with a force which is substantially parallel to the valve member.

In another preferred embodiment there is provided a rocker arm for use in an internal combustion engine having a yoke shaped body formed by an elongated top bar. An enclosed loop hangs down from the bar to define an internal cavity. A side-to-side fulcrum receiving hole is present in the bar adjacent one end of the bar, and a top to bottom valve contact member receiving hole is placed along the bar adjacent an opposite end of the bar.

It is therefore an object of the present invention to provide a cylinder head assembly which affords compact engine design.

It is another object of the present invention to provide a cylinder head assembly which permits more efficient engine cooling.

It is yet another object of this invention to provide an assembly of the foregoing type which results in a reduction of the number of required parts, reduced cost and ease of manufacture.

It is still another object of the present invention to provide a rocker arm of this type having an increased life.

The foregoing and other objects and advantages of the invention will appear from the following description. In the description reference is made to the accompanying drawings in which there is shown by way of illustration preferred embodiments of the invention. Such embodiments do not represent the full scope of the invention. Reference should therefore be made to the claims for interpreting the scope of the present invention.

DESCRIPTION OF THE PREFERRED EMBODIMENTS

Figure 1:
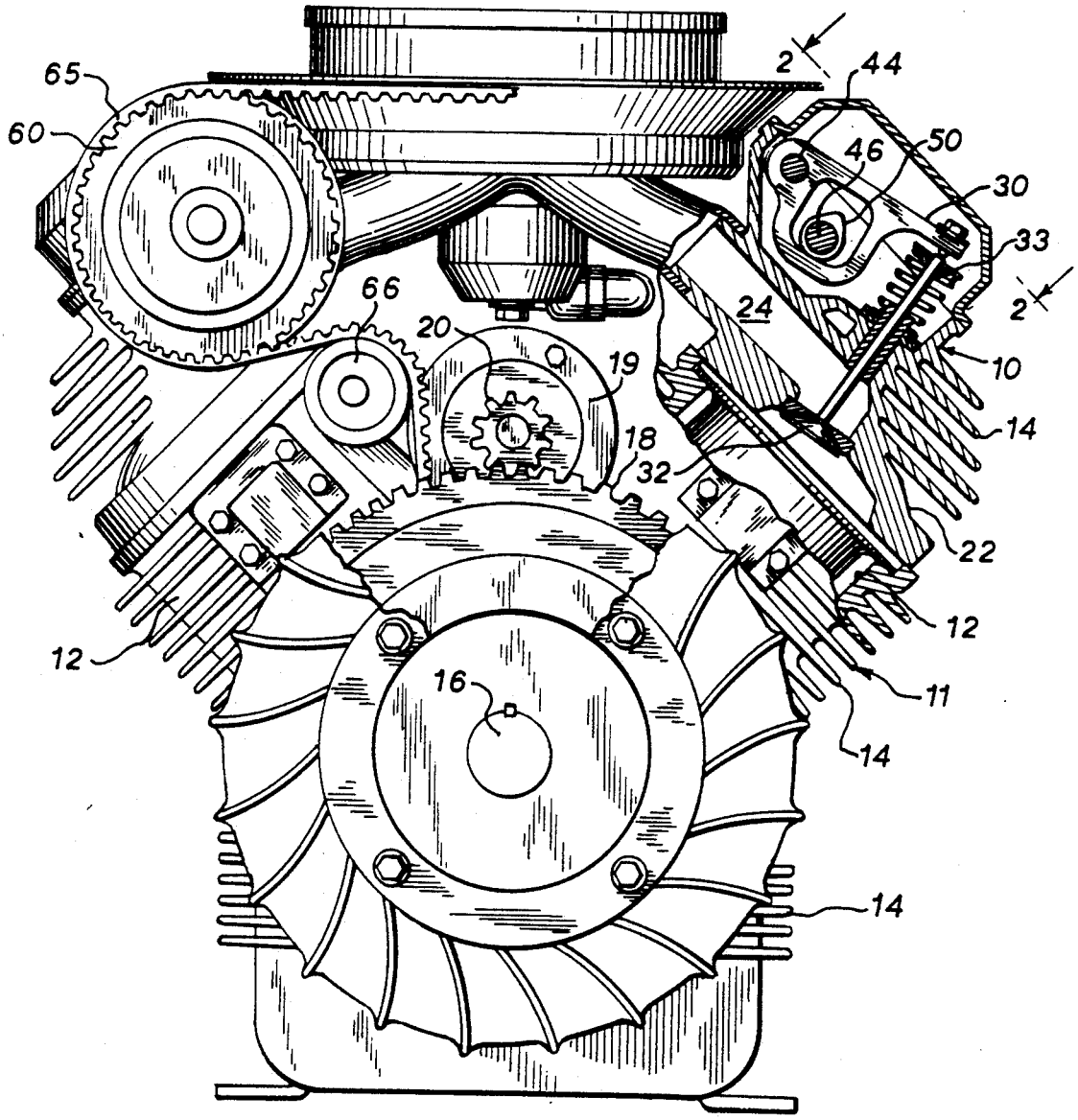
FIG. 1 is a view in side elevation (with parts partially broken away) illustrating the cylinder head assembly and rocker arm of this invention.

Referring to FIG. 1, the cylinder head assembly generally 10 is shown in conjunction with a V-2 engine 11 composed of two cylinders 12 with cooling fins 14. There is the usual crank shaft 16 connected to a ring gear 18 which is engaged by a starter gear 20 of the starter 19.

There is a cylinder head 22 having valve inlet passage 24.

Figure 3:
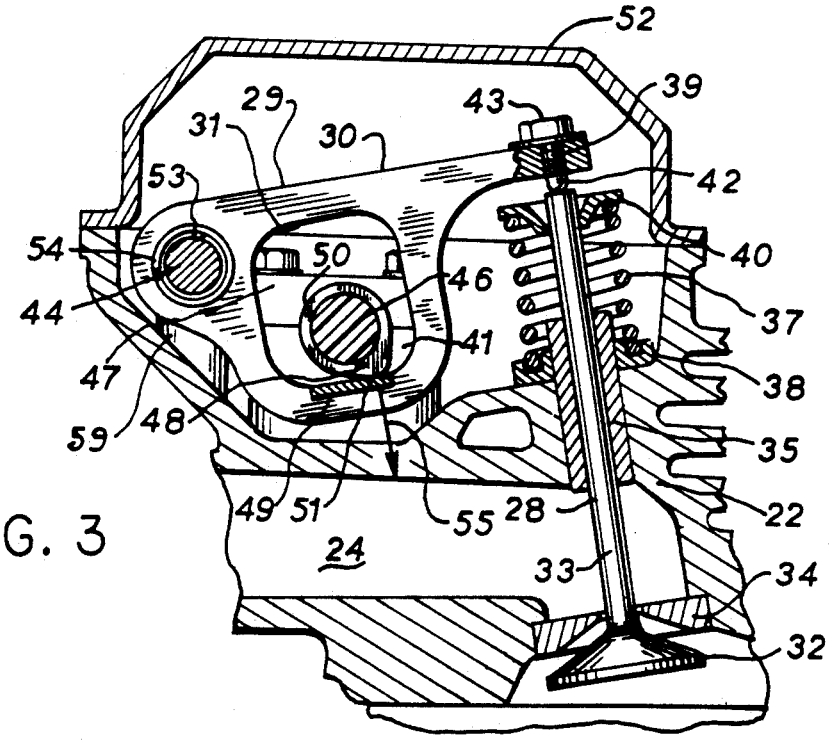
FIG. 3 is a cross sectional view taken along line 3—3 of FIG. 2.

Referring to FIG. 3, there is shown a preferred rocker arm 30 of the present invention with a closed loop portion 31 and a top bar 29 having a threaded vertical passage 39 for receiving the bolt 43 with a valve contact pin 42. Valve member 28 is provided having a stem 33 slidably received in the cylinder head 22 by the guide 35 for intermittent sealing of the valve head 32 with the valve seat 34. The valve head 32 is biased against the seat 34 by the spring 37 positioned on the support 38 and against the retainer 40.

The rocker arm 30 is pivotally hinged in the cylinder head 22 by the shaft 44 extending through a side-to-side opening 53 in the bar 29.

Rocker arm 30 is movable in a reciprocating manner by cam shaft 46 having the camming ring 50 with a cam projection 48 for engagement with the interior cam wear surface 49. In a preferred manner, the rocker arm yoke shaped body is composed of an aluminum material and is manufactured by a metal stamping process known as fine blanking. The rotatable cam shaft 46, as well as the camming ring 50, is composed of a rigid plastic material whereas the cam wear surface 49 is composed of steel.

Figure 2:
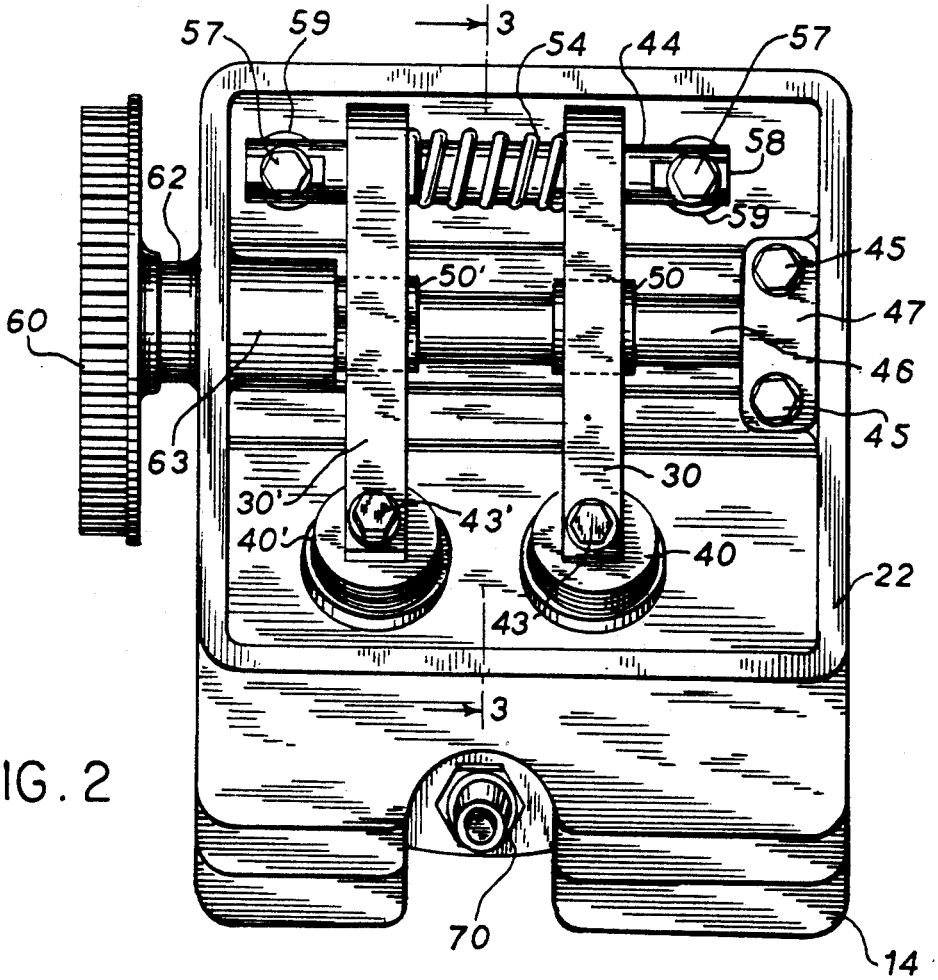
FIG. 2 is a top plan view taken along line 2—2 of FIG. 1.

Referring to FIG. 2, it will be seen that in addition to rocker arm 30 there is a second additional rocker arm 30' in the cylinder head 22 as well as the associated valve contact bolt 43, and the valve spring retainer 40'. In this instance, rocker arm 30' will activate a valve member similar to valve member 28 associated with an outlet valve. Both of the rocker arms 30 and 30' will be reciprocated by the respective camming rings 50 and 50' and a projection such as 48 connected to the common shaft 46.

Shaft 46 is rotatably connected between clamp plate 47 and clamp base 41 (See FIG. 3) by the bolts 45. The shaft 46 is rotated by the pulley 60, and there are suitable spacing elements 62 and 63 which retain the shaft 46 in the cylinder head 22. As seen in FIG. 1, the pulley 60 is rotated by the belt 65 which is guided over idler 66. Belt 65 will be driven by a sheave mounted on crank shaft 16.

As also seen in FIG. 2, the rocker arms 30 and 30' are separated by the spring 54 positioned over the shaft 44. Shaft 44 is nonrotatably positioned in the cylinder head 22 by the bolts 57 extending through the slots 58 and into the base member 59. The cylinder head 22 may have the usual spark plug 70 when a non-diesel head is used.

An important feature of the rocker arms 30 and 30' is the fact that the closed loop portion 31 provides durability. The point of impact between the cam projection 48 and the cam surface 49 leads to forces substantially parallel to the longitudinal axis of the valve stem 33. The arm is dragged downwardly in this parallel manner. This is best seen in conjunction with the arrow 55 shown in FIG. 3.

Also it should be noted that the position of the rocker arms 30 and 30' is low in the cylinder head 22 thus affording a compact design for the cylinder head assembly. In addition, the fact that the rocker arms 30 and 30' are located in the cylinder head 22 obviates external valve actuating members, thus affording additional cooling areas e.g. fins 14 extending to the top of the cylinder head 22. Another added advantage of this is the fact that space is now freed up so that the starter 19 can be located in the V of the engine.

The cylinder head assembly as described in this invention is particularly useful for a V-type internal combustion engine. However, it is applicable to other engine configurations as well.

Certain preferred materials and methods of manufacture have been indicated for certain components. For example, while aluminum is the preferred material for the rocker arms 30 and 30', steel or plastic could be employed. In place of fine blanking, other manufacturing methods such as powdered metal compression or extrusion could be employed to manufacture rocker arms 30 and 30'. The cam shaft 46 is preferably composed of a rigid plastic. However, aluminum and steel could be substituted. A cam wear surface 49 is shown in conjunction with rocker arm 30. This could be eliminated although the life of the arm would not be as great. Also, while a fully enclosed rocker arm cavity 31 is highly preferred, J shaped structures could have a suitable "interior" surface in the bottom of the J where the cam force acts roughly parallel to the axis of the valve 33.

It will be apparent to those skilled in the art that other variations besides these can also be made to the preferred embodiments described herein without departing from the spirit of the invention. The claims should therefore be looked to to judge the full scope of the invention.

I claim:

1. A cylinder head assembly for an internal combustion engine, the assembly comprising:

a cylinder head having a reciprocal valve member;

a fulcrum and a rotatable shaft positioned in the cylinder head;

a rocker arm linked to the fulcrum at a point adjacent a first rocker arm end, and in contact with the valve member adjacent a second rocker arm end;

camming surfaces formed along an interface between the rotatable shaft and an interior surface of the rocker arm, the camming surfaces being located between the rocker arm ends and below the contact point of the rocker arm to the valve member; the rocker arm having an upper portion extending from the first end to the second end, and a loop including the interior surface extending below the upper portion.

2. The assembly as defined in claim 1, wherein there is a cam projection on the rotatable shaft which forms a part of the camming surfaces.

3. The assembly as defined in claim 2, wherein the rocker arm has a wear surface on an interior lower surface of the loop against which the cam on the rotatable shaft can abut.

4. The assembly as defined in claim 3, wherein the rotatable shaft is composed of a plastic material.

5. The assembly as defined in claim 1, wherein the fulcrum is in the form of a fixed shaft that extends through a hole in the rocker arm, whereby the rocker arm can pivot about the shaft.

6. The assembly as defined in claim 5, wherein there are two such rocker arms positioned in a side-by-side manner with respect to each other, and at least two such valve members, wherein the same fixed shaft acts as a fulcrum for both rocker arms, and the same rotatable shaft has cams that abut the rocker arms.

7. The assembly as defined in claim 2, wherein the cam on the rotatable shaft drags the rocker arm downward with a force which is substantially parallel to a valve member longitudinal axis.

8. A rocker arm for use in an internal combustion engine, comprising:

a yoke shaped body formed by an elongated top bar, an enclosed loop hanging down from the bar to define an internal cavity, a portion of the internal cavity being a cam contacting surface for a cam of a camshaft, a side-to-side fulcrum receiving hole in the bar adjacent one end of the bar, and a top to bottom valve contact member receiving hole along the bar adjacent an opposite end of the bar.

9. The rocker arm as defined in claim 8, wherein the internal cavity has a substantially O shape.

10. The rocker arm as defined in claim 9, wherein the body is composed of a first material other than steel, and a wear pad of steel is affixed to the lower internal cavity.

11. The rocker arm as defined in claim 9, wherein the first material is aluminum.

12. The rocker arm as defined in claim 8, wherein the body is produced by fine blanking.

* * * * *

UNITED STATES PATENT AND TRADEMARK OFFICE

CERTIFICATE OF CORRECTION

PATENT NO. : 5,235,942

DATED : August 17, 1993

INVENTOR(S) : Jaroslav J. Olmr

It is certified that error appears in the above-indentified patent and that said Letters Patent is hereby corrected as shown below:

| | |
|---|---|
| Column 2, line 67 | after "second" "additional" should be underscored. |
| Column 3, line 1 | after "contact" "bolt 43," should be --bolt 43'--. |
| Column 3, line 5 | This should not be a new paragraph. |

Signed and Sealed this

Twelfth Day of April, 1994

Bruce Lehman

*Attest:*

BRUCE LEHMAN

*Attesting Officer*

*Commissioner of Patents and Trademarks*